US006835016B2

(12) United States Patent
Noguchi

(10) Patent No.: US 6,835,016 B2
(45) Date of Patent: Dec. 28, 2004

(54) STICK PROJECTING DEVICE

(75) Inventor: Yoshio Noguchi, Saitama-ken (JP)

(73) Assignee: Kotobuki & Co., LTD, Kyoto (JP)

( * ) Notice: Subject to any disclaimer, the term of this patent is extended or adjusted under 35 U.S.C. 154(b) by 17 days.

(21) Appl. No.: 10/158,169

(22) Filed: May 31, 2002

(65) Prior Publication Data

US 2003/0129012 A1 Jul. 10, 2003

(30) Foreign Application Priority Data

Jan. 10, 2002 (JP) ..... 2002-003365

(51) Int. Cl.[7] ..... A45D 40/06

(52) U.S. Cl. ..... 401/75; 401/68; 401/76; 401/86; 401/87

(58) Field of Search ..... 401/75, 76, 68, 401/77, 78, 79, 82, 86, 87

(56) References Cited

U.S. PATENT DOCUMENTS 3,216,563 A * 11/1965 Finkenzeller ..... 401/86 X
3,358,699 A * 12/1967 Bau ..... 401/76 X
5,836,708 A * 11/1998 Tani ..... 401/75 X
5,879,093 A * 3/1999 Ohba et al. ..... 401/75 X
5,888,004 A * 3/1999 Bouix ..... 401/75 X

* cited by examiner

*Primary Examiner*—Gregory L. Huson
*Assistant Examiner*—Kathleen J. Prunner
(74) *Attorney, Agent, or Firm*—Rothwell, Figg, Ernst & Manbeck, p.c.

(57) ABSTRACT

A stick projecting device has a barrel as a case body comprising a front barrel and a rear barrel both of which are configured rotatably with regard to each other. A piston rod oval in section, having uncontinuous male thread portions is slidably fitted in the barrel. A driver having a female thread portion in mesh with the male thread portions is provided in the front barrel. A locking member that prevents the piston rod from turning is secured to the front barrel at a position forwardly of the driver. An inner cylinder is movably provided in the front barrel and the tip of the inner cylinder is able to be in abutment with a part of the front interior of the front barrel. A part of a stick that has been projected from the opening of the tip of the front barrel can be restored in the front barrel by a reverse turning operation of the rear barrel.

7 Claims, 13 Drawing Sheets

STICK PROJECTING DEVICE

BACKGROUND OF THE INVENTION

1. Field of the Invention

The present invention relates to a stick projecting device capable of projecting by a turning operation a stick-form cosmetic or stick-form stationery such as paste that are formed by way of a filling step of bulk liquid or other steps.

2. Description of the Prior Art

Stick projecting devices of the type in which a stick is formed by filling a casing with bulk liquid by the use of a spray nozzle have been proposed. In such stick projecting devices, once the stick is pressed out by a turning operation to project from the tip opening of a front barrel, the projecting portion of the stick cannot be restored into the front barrel even if the stick is reversely turned. The reason is that these stick projecting devices have difficulty in forming a chuck for grasping the stick filled or a cylindrical portion for sheathing the same. Accordingly, it is impossible to restore the stick excessively projected to its easy-to-use position or appropriate position, with the result that the device is inevitably used with the stick projected excessively.

Consequently, it becomes difficult to adjust force to use the stick, which leads to the breakage of the stick due to an excessive load which will be applied on the stick for use. In this case, not only it is difficult to use the broken stick as it is but a problem arises that the broken stick makes other parts or places dirty. If the excessively projected stick is broken before used, another projecting operation of the stick has to be performed. This means that it takes time and effort to assume a state in which the stick is available, and among others, the stick is consumed wastefully.

SUMMARY OF THE INVENTION

Accordingly, the present invention has been made to solve the above problems caused by the excessively projecting stick, and an object of the present invention is to provide a stick projecting device capable of restoring an excessively projected stick to an appropriate length without causing damage to the stick.

Another object of this invention is to provide a stick projecting device in which, when a rear barrel is reversely turned beyond a rearward displacing range of a piston rod, an idle-turning mechanism acts on the piston rod and the idle-turning prevents components from being damaged.

Still another object of this invention is to provide a stick projecting device in which engaging protrusions, of a driver, constituting an idle-turning mechanism are each made not laterally symmetrical but deformative, and the magnitude of friction resistance generated when projecting a stick and retracting the same is varied using a difference in friction resistance caused by the turning directions of the driver, thereby improving operability.

According to an aspect of the present invention, there is provided a stick projecting device in which a piston rod constituting a part of a projecting mechanism for projecting a stick is provided for insertion in an inner cylinder for holding substantially all the stick and the stick is allowed to move backward together with the inner cylinder when the piston rod is moved backward.

According another aspect of this invention, there is provided a stick projecting device comprising: a barrel made up of a front barrel and a rear barrel which are incorporated rotatably relative to each other and storing a stick therein; a piston rod having a male thread portion provided thereon, said piston rod being slidably provided in the barrel; a driver which has a female thread portion in mesh with the piston rod, said driver being rotatably provided within the front barrel; a locking member which prevents the piston rod from turning, said locking member being fixedly provided at a position forwardly of the drive but within the front barrel; and an inner cylinder which is movably provided in the front barrel, a tip of the inner cylinder being capable of being in abutment with a part of the front inner wall of the front barrel.

BRIEF DESCRIPTION OF THE DRAWINGS

The invention disclosed herein will be understood better with reference to the following drawings in which.

DETAILED DESCRIPTION OF THE PREFERRED EMBODIMENT

A stick projecting device in a preferred embodiment according to the present invention will be described hereinafter with reference to the accompanying drawings.

Figure 1:
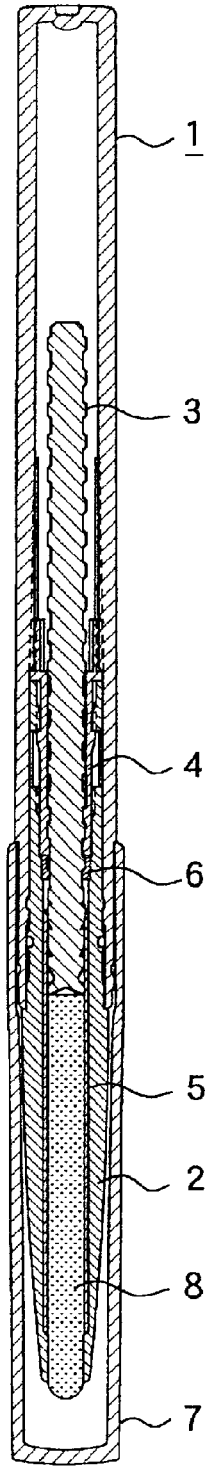
FIG. 1 is a longitudinally sectional view of a stick projecting device according to an embodiment of the present invention.
Figure 2:
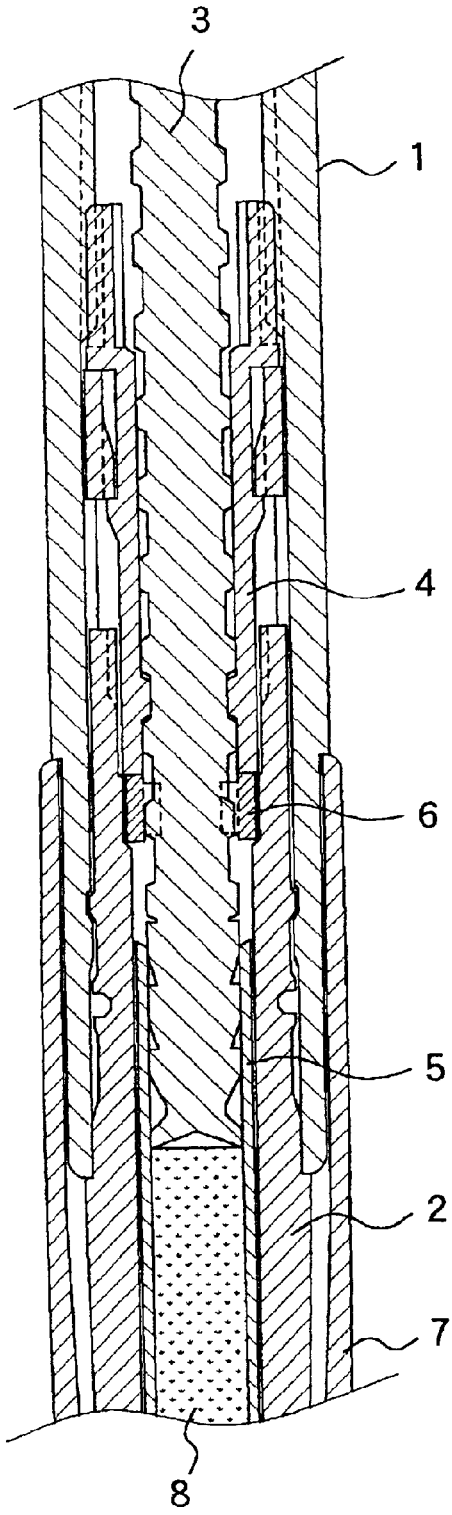
FIG. 2 is an enlarged, longitudinally sectional view of the primary portion of the device in FIG. 1.

FIGS. 1 and 2 show a stick projecting device for projecting a stick such as an eyeliner according to the embodiment of the present invention. In the figures, a barrel as a case body is composed of a tapered front barrel 2 and a bottomed rear barrel 1, both of which are configured rotatably with regard to each other.

Figure 3:
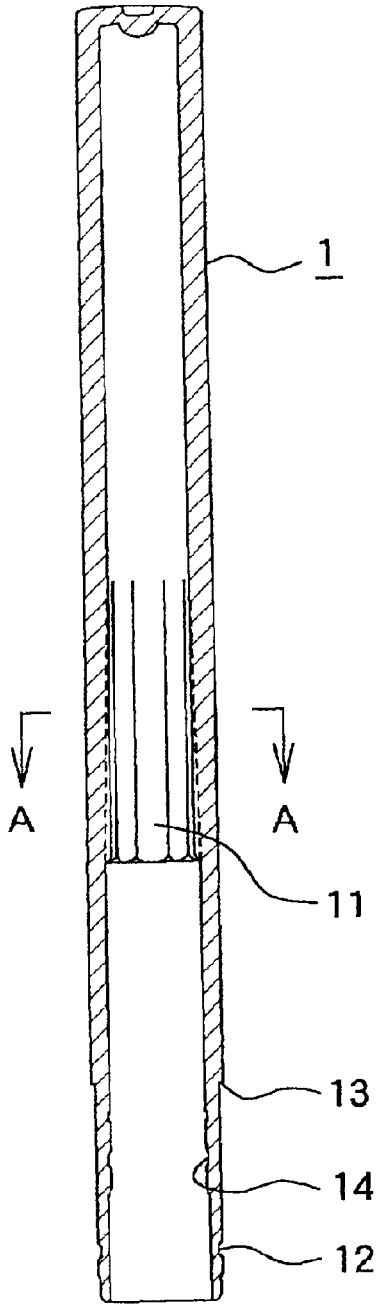
FIG. 3 is a longitudinally sectional view of a rear barrel of the device in FIG. 1.
Figure 4:
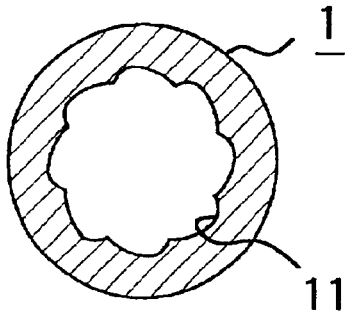
FIG. 4 is a sectional view of the rear barrel taken along line A—A in FIG. 3.

FIGS. 3 and 4 show the rear barrel 1, which has laterally asymmetrically deformed recesses 11 acting as a stopper disposed on the inner circumference thereof. The deformed recesses 11 are each formed shallower progressively rearward in view of molding. The rear barrel 1 has an annular recess 12 for fitting a cap 7 (described later) formed at a position on the outer circumference of the forward portion thereof. A stopper step 13 against which the open end of the cap 7 comes into abutment is formed at a position rearwardly of the annular recess 12. In addition, a fitting groove 14 for rotatably fitting the front barrel 2 is formed at a position between the annular recess 12 and the stopper step 13, on the inner circumference of the front barrel 2.

Figure 5:
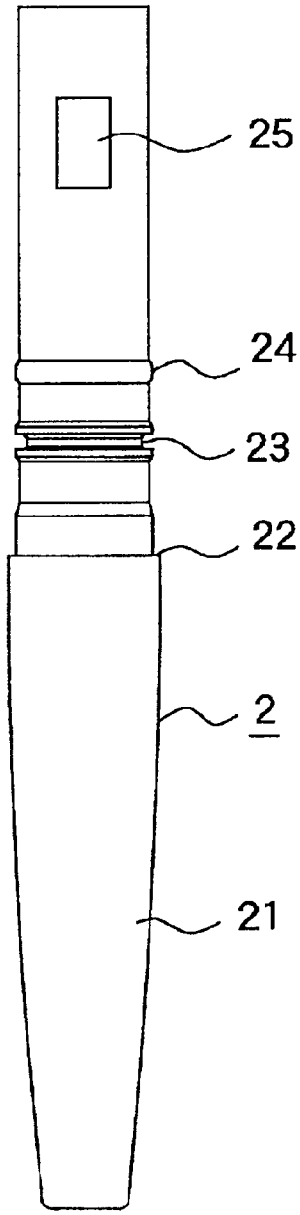
FIG. 5 is a front view of a front barrel of the device in FIG. 1.
Figure 6:
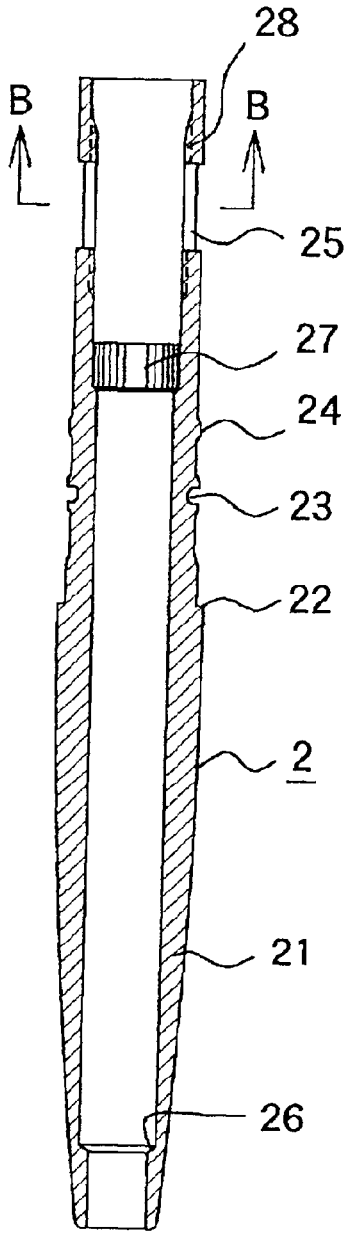
FIG. 6 is a longitudinally sectional view of the front barrel in FIG. 5.
Figure 7:
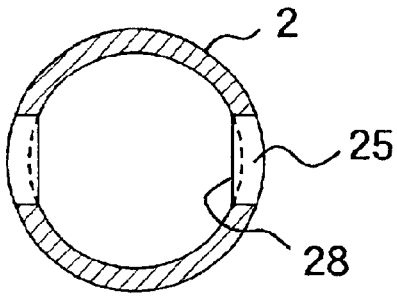
FIG. 7 is a sectional view of the front barrel taken along line B—B in FIG. 6.

FIGS. 5 to 7 show the front barrel 2 having a front part 21 the outside diameter of which is made smaller progressively toward the tip of the front part 21. An abutting step 22 is formed adjacently to the rear end of the front part 21. Furthermore, an annular groove 23 for receiving an O-ring provided as needed is formed apart from the abutting step 22. Incidentally, rectangular holes 25 in engagement with a driver 4 described later are formed in a rear side wall of the front barrel 2. The rectangular hole 25 extends in the axial direction of the front barrel 2. The rectangular hole 25 is formed in order to make the driver 4 rotatable with regard to the front barrel 2 and prevent the driver 4 from disengaging from the front barrel 2. The engagement part 43 of the driver 4 is in engagement with D-cuts of the rectangular holes 25. A detent 24 is formed between the annular groove 23 and the rectangular hole 25. A step 26 acting as a stopper is formed at a position on the inner circumference of the tip portion of the front barrel 2 and nicks 27 for engagement are provided at a position on the inner circumference of the rear portion.

Figure 8:
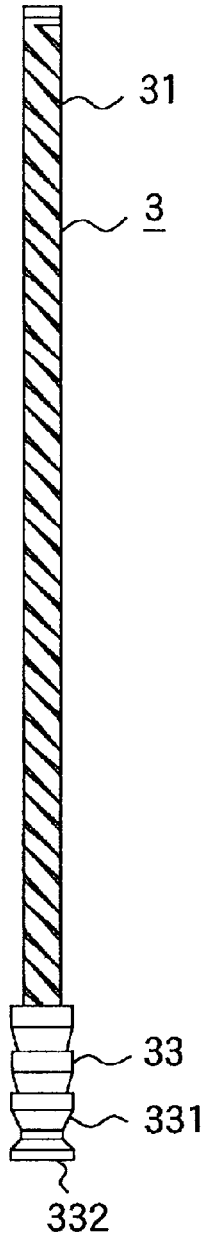
FIG. 8 is a front view of a piston rod in FIG. 1.
Figure 9:
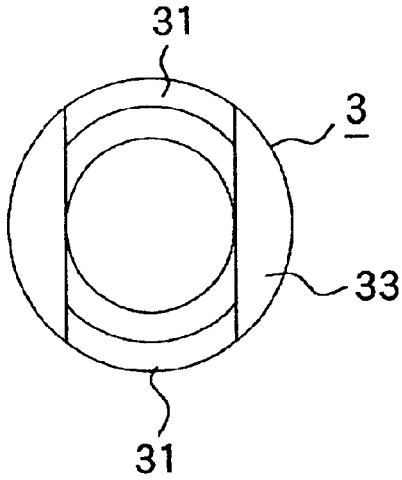
FIG. 9 is an enlarged bottom view of the piston rod in FIG. 8.
Figure 10:
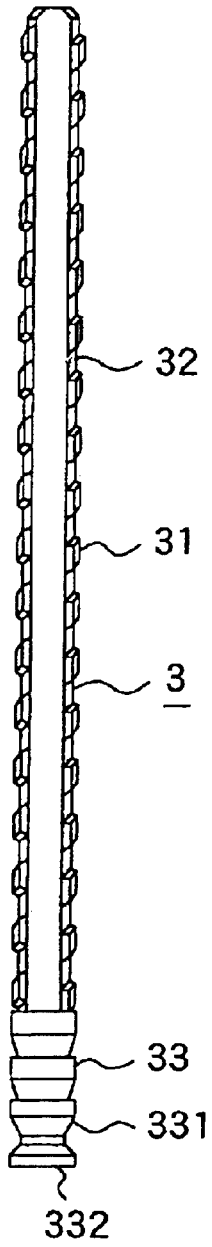
FIG. 10 is a side view of the piston rod in FIG. 8.
Figure 11:
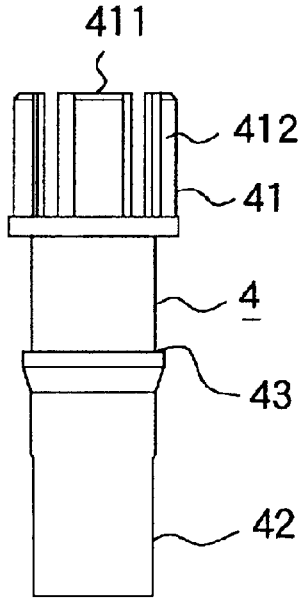
FIG. 11 is a front view of a driver in FIG. 1.

FIGS. 8 to 10 show an elongated piston rod 3 having a circular/oval cross section. Male threads 31 and flat surfaces 32 are alternately formed on the outside of the piston rod 3. A press-fitting part 33 circular in section which has a plurality of inclined step parts 331 and an end portion 332 are provided at the front end of the piston rod 3. The press-fitting part 33 is fitted into the rear portion of an inner cylinder 5 for supporting the stick (described later) by press-fitting. The outside diameter of the press-fitting part 33 is therefore required to be slightly greater than the inside diameter of the inner cylinder 5.

FIGS. 11 to 14 show the driver 4 including an idle-turning part 41 having a large diameter as the rear part thereof and a cylindrical part 42 as the front part thereof. When the driver 4 is assembled into the front barrel 2, the front end of the idle-turning part 41 of the driver 4 is brought into abutment against and in engagement with the rear end of the front barrel 2. The idle-turning part 41 includes four upright walls 411 each of which has a sliding part 412 outwardly projecting on the outer wall of the upright wall 411 and sliding along the inner wall of the rear barrel 1.

Figure 12:
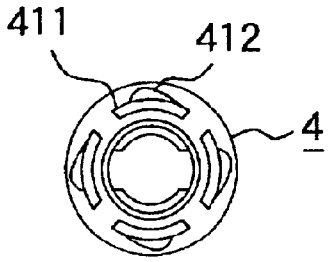
FIG. 12 is a plan view of the driver in FIG. 11.
Figure 13:
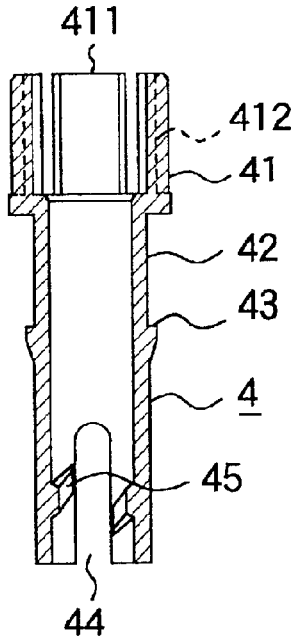
FIG. 13 is a longitudinally sectional view of the driver in FIG. 12.
Figure 14:
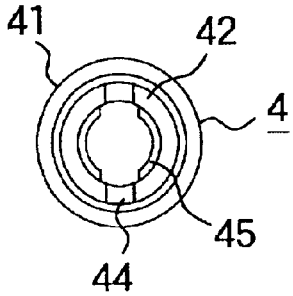
FIG. 14 is a bottom view of the driver in FIG. 12.

These sliding parts 412 each have a laterally asymmetrically deformed protrusion as apparent from FIG. 12. That is, the deformed protrusion has different inclined angles so that a difference in friction resistance is created depending on the turning directions of the rear barrel 1. More specifically, the inclination of the sliding part 412 is set gently so that the driver 4 turns counterclockwise more easily than it turns clockwise to reduce the friction resistance. When the stick 8 is projected by the clockwise turn of the rear barrel, the friction resistance between the driver 4 and the rear barrel 1 is made greater than that between the piston rod 3 and the inner cylinder 5, so that the stick is projected. On the other hand, when the stick 8 is restored by the reverse turn, namely, counterclockwise turn of the rear barrel 1, the friction resistance between the driver 4 and the rear barrel 1 is made smaller than that between the piston rod 3 and the inner cylinder 5, so that the stick 8 is restored smoothly. In this case, the piston rod 3 moves rearward at a predetermined interval together with the inner cylinder 5 holding the stick 8 and the rear end of the inner cylinder 5 comes into abutment against the front end of a stopper ring 6. Thereafter, the piston rod 3 idly turns due to the operation of the idle-turning part 41 of the driver 4. Thus, an excessive load is not imposed on each component.

The driver 4 has the engagement part 43 formed on the intermediate outer circumference of the cylindrical part 42 forwardly of the idle-turning part 41, and is prevented from disengaging from the front barrel 2 with the help of the D-cuts 28 of the front barrel 2. A pair of expanding slots 44 extending in a longitudinal direction is formed oppositely to each other on the front end side wall of the driver 4. In addition, female thread portions 45 are each formed between and on the back side of the pair of expanding slots 44.

The inner cylinder 5 into which the press-fitting part 33 of the piston rod 3 is fitted will be described. The inner cylinder 5 is a thin cylindrical body. Metal or preferable alternative materials of the metal, such as POM (Polyacetal) or PC (polycarbonate) is used as a material for the inner cylinder 5. The corner on the front end outside of the inner cylinder 5 is chamferred off at an angle in which it is easily engaged with the abutting step 22 formed on the inside of the front portion of the front barrel 2. On the other hand, the corner on the rear end outside is chamferred so that the press-fitting part 33 of the piston rod 3 is easily press-fitted thereto.

Figure 15:
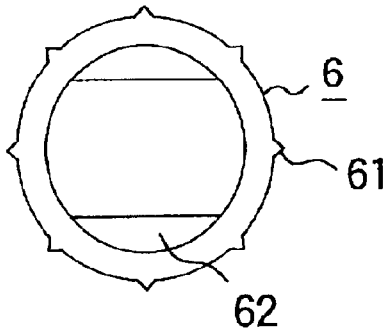
FIG. 15 is a plan view of a stopper ring in FIG. 1.
Figure 16:
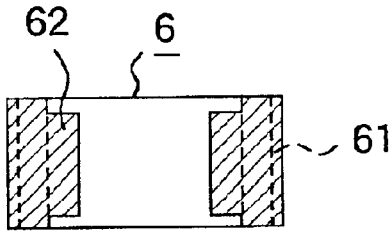
FIG. 16 is a longitudinally sectional view in FIG. 15.

FIGS. 15 and 16 show a stopper ring 6 acting as a locking member that is secured to the inside of the front barrel 2 so as to restrict the turning of the piston rod 3. This stopper ring 6 has pointed retaining projections 61 on the outer circumference thereof. The stopper ring 6 is retained in the nicks 27 formed on the inner circumference of the front barrel 2 with the help of the retaining projections 61. The stopper ring 6 has on the inside thereof stopper parts 62 that come into engagement with the flat surfaces 32 of the piston rod 3 so as to perform an engaging function, as shown in FIG. 16. Incidentally, reference numeral 7 denotes the cap that is fitted to the outside of the front part of the rear barrel 1 to keep airtightness for the purpose of preventing drying of the stick 8.

A procedure for assembling the stick projecting device will be described hereinafter for assistance in understanding the construction of the stick projecting device.

First, the inner cylinder 5 made of a thin cylindrical body is inserted into the front barrel 2 from the rearward thereof. At this time, the inner cylinder 5 is forcibly loaded until the tip of the inner cylinder 5 is brought into abutment against the stopper step part 26 formed on the inner circumference of the tip of the front barrel 2. Thereafter, the opening of the front part 21 of the front barrel 2 is closed with a front plug (not shown) in necessary form. A spray nozzle is inserted into the front barrel 2 from the rearward thereof, and a bulk liquid is charged into the inner cylinder 5 while the nozzle is gradually pulled rearward. The bulk liquid then solidifies to form the stick 8 in the inner cylinder 8. Incidentally, the top plug mentioned above is removed after the charging operation is completed.

A semi-assembled component consisting of the piston rod 3, the stopper ring 6 and the driver 4 is inserted into the front barrel 2 from the rearward thereof. Incidentally, a method of securing the semi-assembled component to the front barrel 2 is that the engagement part 43 of the driver 4 is brought into engagement with the so-called D-cuts 28 formed at the rectangular hole 25 of the front barrel 2, which prevents the semi-assembled component from easily disengaging from the front barrel 2.

When the semi-assembled component is brought into engagement with the front barrel 2, a part of the stick 8 formed by the charging is pressed out from the tip of the front barrel 2 by the piston rod 3. Therefore, it is necessary that the stick 8 is previously positioned inside the tip of the front barrel 2. After a set of the front barrel with the semi-assembled component is fitted to the rear barrel 1, the cap 7 is finally fitted on the front barrel 2. Thus, the assembling of the stick projecting device is completed. Another method may be adopted; the inner cylinder 5 that is inserted into the front barrel 2 from the rearward thereof is directly filled with the bulk liquid before it is inserted into the front barrel 2. To be more specific, a front plug for charging is attached to the tip of the inner cylinder 5 in advance. The bulk liquid is then charged into the inner cylinder 5 from the rearward thereof. Next, the bulk liquid charged inner cylinder 5 is loaded into the front barrel 2 from the rearward thereof. Thereafter, the semi-assembled component including the piston rod 3 is fixedly press-fitted into the set of the inner cylinder 5 and the front barrel 2 from the rearward of the set. The rear barrel 1 is fitted to the front barrel 2 and then the cap 7 is fitted on the front barrel 2. Thus, the stick projecting device is assembled. Furthermore, another method may be adopted; all the components other than the cap 7 are assembled before the bulk liquid is charged into the inner cylinder 5 from forward of the front barrel 2 with the front barrel 2 standing upward.

The operation of the stick projecting device according to the invention will be hereinafter described.

First, when projecting the stick 8, the cap 7 is removed from the front barrel 2 and the rear barrel 1 is turned relative to the front barrel 2. In this time, the driver 4 secured to the front barrel 2 is turned because the deformed recesses 11 of the rear barrel 1 is engaged with the sliding parts 412 of the idle-turning part 41 of the driver 4. The female thread portions 45 of the driver 4 come in mesh with the male thread portion 31 of the piston rod 3, and thereby the piston rod 3 is about to move forward while turning.

On the other hand, the flat surfaces 32 of the piston rod 3 are in engagement with the stopper parts 62 inside the stopper ring 6. More specifically, since the piston rod 3 has an oval cross section, the turn of the piston rod 3 is restricted, i.e., locked by the stopper parts 62, with the result that the piston rod 3 is allowed to move forward within the barrel. As the piston rod 3 moves forward, a part of the stick 8 is projectingly pressed out of the inner cylinder 5 because the top of the inner cylinder 5 is retained by the stopper step part 26 of the front barrel 2. In short, by turning the rear barrel 1, the piston rod 3 is allowed to move forward together with the inner cylinder 5 so as to press out a part of the stick 8 from the tip of the front barrel 2.

When restoring an excessive projecting part of the stick, the rear barrel 1 is reversely turned to cause the piston rod 3 to move backward. At this time, the inner cylinder 5 is restored backward together with the piston rod 3. More specifically, the outside diameter of the piston rod 3 is set to be greater than the inside diameter of the inner cylinder 5 and a clearance is previously formed between the inner cylinder 5 and the front barrel 2. This eliminates the fact that the inner cylinder 5 is fitted into the front barrel 2 to remain at that position, whereby only the piston rod 3 is restored rearward. A distance in which the piston rod 3 can be displaced backward is determined by the distance of the space between the inner cylinder 5 and the stopper ring 6. If additional force acts on the inner cylinder 5 after the inner cylinder 5 has come into abutment with the stopper ring 6, the driver 4 is idly turned by the operation of the idle-turning part 41 provided at the rear portion of the driver 4 so that a space is not formed between the stick 8 and the piston rod 3.

More specifically, if the front barrel 2 or the rear barrel 1 is turned reversely excessively beyond the distance in which the piston rod 3 can be displaced backward, that is, a distance in which the inner cylinder 5 can be displaced, the plurality of upright walls 411 constituting the idle-turning part 41 provided at the rear portion of the driver 4 are inwardly distorted to absorb the rotational force, whereby the driver 4 is idly turned relative to the rear barrel 1. Consequently, the piston rod 3 is not allowed to move more backward, which leads to the advantage that there is no possibility that an excessive load acts on each of the components to cause damage to the components. In addition, there is another advantage that since most of the stick 8 in the front barrel 2 always stays within the inner cylinder 5, the stick 8 is highly resistant to shock caused by a drop or the like and thus is free from breakage.

As apparent from the foregoing description, the stick projecting device in accordance with the present invention is capable of adjustably restoring an excessively projecting stick to an adequate length; therefore, the stick can be saved, and is highly resistant to shock and is free from breakage.

According to the stick projecting device of the present invention, even if the front barrel or rear barrel is turned beyond the range of displacement of the piston rod, the piston rod is idly turned so as to prevent the components from being damaged.

The stick projecting device has the driver including the sliding protrusions that are each deformed laterally asymmetrically so that a difference in turning friction resistance is provided depending on the turning directions of the rear barrel. Thus, the friction resistance generated when projecting the stick and restoring the same is varied, which makes the turning operation smooth.

While a preferred embodiment of the invention has been described using specific terms, such description is for illustrative purposes only, and it is to be understood that changes and variations may be made without departing from the spirit or scope of the following claims.

What is claimed is:

1. A stick projecting device comprising:

a barrel having a front barrel portion and a rear barrel portion and storing a stick therein, said front barrel portion being rotatable relative to said rear barrel portion;

a piston rod having a thread portion provided thereon, said piston rod being slidably provided in said barrel;

a driver having a thread portion mating with said thread portion of said piston rod, said driver being rotatable with said front barrel portion;

a locking member operable to prevent said piston rod from turning, said locking member being fixedly disposed within said front barrel portion and forwardly displaced from said driver; and an inner cylinder movably provided in said front barrel portion, wherein a tip of said inner cylinder is in abutment with a part of a front inner wall surface of said front barrel portion.

2. The stick projecting device according to claim 1, wherein the inside diameter of said inner cylinder is smaller than the outside diameter of a fitting part of said piston rod so that said piston rod is insertably press-fitted into said inner cylinder.

3. The stick projecting device according to claim 1, wherein said inner cylinder has a cylindrical body for accommodating the stick, and the outer surface at the rear end of said inner cylinder is chamferred so that said piston rod is easily press-fitted into said inner cylinder.

4. The stick projecting device according to claim 1, wherein the outer diameter of said inner cylinder and the inner diameter of said front barrel portion form a clearance therebetween.

5. The stick projecting device according to claim 1, wherein said driver includes an idle-turning part operable to idly turn relative to said rear barrel portion.

6. The stick projecting device according to claim 1, wherein an idle-turning part of said driver includes a plurality of upright walls and deformed protrusions provided on their respective exteriors of said plurality of upright walls, each of the deformed protrusions having different inclined angles.

7. The stick projecting device according to claim 6, wherein said rear barrel portion is formed with deformed recesses and are progressively shallower toward the rearward.

* * * * *